US010330386B2

(12) United States Patent
Fukuchi et al.

(10) Patent No.: US 10,330,386 B2
(45) Date of Patent: Jun. 25, 2019

(54) STEEL SHEET HEATING METHOD AND STEEL SHEET HEATING APPARATUS

(71) Applicant: NIPPON STEEL & SUMITOMO METAL CORPORATION, Tokyo (JP)

(72) Inventors: Hiroshi Fukuchi, Tokyo (JP); Naruhiko Nomura, Tokyo (JP); Atsushi Seto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 240 days.

(21) Appl. No.: 15/108,975

(22) PCT Filed: Jan. 23, 2015

(86) PCT No.: PCT/JP2015/051832
§ 371 (c)(1),
(2) Date: Jun. 29, 2016

(87) PCT Pub. No.: WO2015/115327
PCT Pub. Date: Aug. 6, 2015

(65) Prior Publication Data

US 2016/0320128 A1 Nov. 3, 2016

(30) Foreign Application Priority Data

Jan. 30, 2014 (JP) ..... 2014-015536

(51) Int. Cl.
*F27D 3/00* (2006.01)
*F27D 3/12* (2006.01)
(Continued)

(52) U.S. Cl.
CPC ..... *F27D 3/12* (2013.01); *B21D 22/022* (2013.01); *B21D 22/208* (2013.01); *B21D 53/88* (2013.01);
(Continued)

(58) Field of Classification Search
CPC .... B21D 22/022; B21D 22/208; B21D 37/16; C21D 9/0018; C21D 9/0025; C21D 9/005;
(Continued)

(56) References Cited

U.S. PATENT DOCUMENTS 1,858,434 A * 5/1932 Colby ..... F27B 9/2461 34/242
1,914,642 A * 6/1933 Leach ..... C21D 9/46 432/11
(Continued)

FOREIGN PATENT DOCUMENTS

CN 201067739 Y 6/2008
CN 102010967 A 4/2011
(Continued)

OTHER PUBLICATIONS

Taiwanese Office Action and Search Report, dated Jul. 14, 2016, for Taiwanese Application No. 104102706, together with an English translation thereof.
(Continued)

*Primary Examiner* — Gregory D Swiatocha
(74) *Attorney, Agent, or Firm* — Birch, Stewart, Kolasch & Birch, LLP

(57) ABSTRACT

A steel sheet heating method that heats a steel sheet (K) to be pressed before hot press molding includes: bringing the steel sheet into a heating furnace (10) including a heater (15) on an inside surface of the heating furnace in a state where the steel sheet is supported in a vertical direction while an unnecessary portion of the steel sheet that becomes unnecessary after molding is fixedly supported by a support member (30); and performing heating at a prescribed temperature in the heating furnace, then taking the steel sheet out of the heating furnace, and after that cutting and remov-
(Continued)

ing the unnecessary portion before hot press molding or during hot press molding.

6 Claims, 4 Drawing Sheets

(51) Int. Cl.

| | |
|---|---|
| ***B21D 22/02*** | (2006.01) |
| ***B21D 22/20*** | (2006.01) |
| ***B21D 53/88*** | (2006.01) |
| ***F27D 13/00*** | (2006.01) |
| ***F27D 99/00*** | (2010.01) |

(52) U.S. Cl.
CPC ..... *F27D 3/0024* (2013.01); *F27D 13/00* (2013.01); *F27D 2003/0075* (2013.01); *F27D 2099/0088* (2013.01); *F27M 2001/1565* (2013.01); *F27M 2003/02* (2013.01)

(58) Field of Classification Search
CPC ..... C21D 9/0056; C21D 9/46; C21D 9/48; F27D 2003/0015; F27D 2003/0034–0048; F27D 2003/0086; F27D 2003/0014; F27D 2003/0016; F27D 2003/0059; F27D 2003/006; F27D 2003/0063; F27D 2003/0068; F27D 2003/0075; F27D 3/12; F27D 3/0024
See application file for complete search history.

(56) References Cited

U.S. PATENT DOCUMENTS

| | | | | |
|---|---|---|---|---|
| 2,069,057 | A * | 1/1937 | Dany | C23D 9/00 432/136 |
| 2,172,386 | A * | 9/1939 | Huff | C21D 9/46 266/249 |
| 2,370,381 | A * | 2/1945 | Vaughan | C03B 23/031 104/28 |
| 2,839,289 | A * | 6/1958 | Holscher | C21D 9/46 266/117 |
| 4,094,659 | A * | 6/1978 | Nixon | C03B 23/031 65/104 |
| 7,513,137 | B2 | 4/2009 | Kröger et al. | |
| 2006/0137779 | A1 | 6/2006 | Brodt et al. | |
| 2007/0007272 | A1 | 1/2007 | Napoli et al. | |
| 2013/0048161 | A1 * | 2/2013 | Matsuda | C21D 1/22 148/653 |
| 2014/0312024 | A1 | 10/2014 | Egawa et al. | |
| 2016/0076116 | A1 | 3/2016 | Baettenhausen et al. | |

FOREIGN PATENT DOCUMENTS

| | | | |
|---|---|---|---|
| JP | 6-14891 | U | 2/1994 |
| JP | 7-278647 | A | 10/1995 |
| JP | 2009-155691 | A | 7/2009 |
| JP | 2013-94815 | A | 5/2013 |
| RU | 2262408 | C1 | 10/2005 |
| SU | 210208 | A1 | 1/1967 |
| SU | 1212677 | A | 2/1986 |
| WO | WO 2013/084512 | A1 | 6/2013 |
| WO | WO 2014/173703 | A1 | 10/2014 |

OTHER PUBLICATIONS

Chinese Office Action and Search Report for corresponding Chinese Application No. 201580005177.3, dated Apr. 6, 2017, with an English translation of the Chinese Office Action.
Extended European Search Report for corresponding European Application No. 15743857.3, dated May 11, 2017.
Chinese Office Action and Search Report, dated Nov. 27, 2017, for Chinese Application No. 201580005177.3, as well as a partial translation of the Chinese Office Action.
Canadian Office Action for Canadian Application No. 2,934,838, dated Jul. 26, 2017.
Korean Office Action for Korean Application No. 10-2016-7019200, dated Jul. 14, 2017, with a Machine translation.
Russian Office Action and Search Report for Russian Application No. 2016129111, dated Aug. 2, 2017, with a Machine translation.
International Search Report for PCT/JP2015/051832 dated Apr. 21, 2015.
Written Opinion of the International Searching Authority for PCT/JP2015/051832 (PCT/ISA/237) dated Apr. 21, 2015.
Korean Office Action, dated Feb. 19, 2018, for corresponding Korean Application No. 10-2016-7019200, with a partial English translation.
Indian Examination Report for corresponding Indian Application No. 201617021429, dated Mar. 13, 2019, including a partial English translation.
Indonesian Office Action for corresponding Indonesian Application No. P00201604689, dated Jan. 17, 2019, with an English translation.

* cited by examiner

STEEL SHEET HEATING METHOD AND STEEL SHEET HEATING APPARATUS

TECHNICAL FIELD

The present invention relates to a steel sheet heating method and a steel sheet heating apparatus for heating a steel sheet.

BACKGROUND ART

Hot press molding, which is increasingly employed as, for example, a method for molding a steel sheet such as the material of an automobile component using a high-tensile steel sheet, can mold a steel sheet in a stage of low deformation resistance by molding it at high temperature, and furthermore can provide a component etc. with high strength and high shape accuracy by press molding without causing molding defects such as deformation after molding, by hardening by quenching based on rapid cooling using the jetting of cooling water.

In such a hot press molding method, press molding is performed such that a steel sheet is heated at a prescribed temperature, for example 700° C. to 1000° C., in a heating furnace before press molding and then the steel sheet is conveyed to a hot press molding apparatus.

As the technology of heating thus using a heating furnace, conventionally, a mechanism in which a steel sheet is heated by heaters provided in, for example, an upper portion and a lower portion of the interior of a furnace while the steel sheet is horizontally supported by rollers and conveyed by the rollers in the furnace has commonly been used (Patent Literature 1).

CITATION LIST

Patent Literature

Patent Literature 1: JP 2009-155691A

SUMMARY OF INVENTION

Technical Problem

However, in the conventional technology mentioned above, since a steel sheet is conveyed by rolling rollers, the steel sheet may meander in the furnace. Furthermore, the rollers constitute a shield, and the radiation efficiency is poor and rapid heating is difficult. In addition, it is necessary to roll the rollers constantly even at times other than conveyance in order to soak the rollers so that they are not thermally deformed, and the energy efficiency is poor. Moreover, due to the thermal shock near the entrance of the furnace and the thermal stress produced by the unevenness of heating, there has been a concern that the roller will be degraded or damaged. If the roller is damaged, the operation of the furnace stops. Furthermore, for a surface-plated steel sheet, there have been concerns that the plating material will adhere to the roller in the melting temperature range and further the plating material adhering to the roller will adhere to the steel sheet again.

The present invention is made in view of these points, and an object of the present invention is to solve the issues mentioned above by a manner in which a steel sheet is brought into a furnace and is heated in a state of being fixedly supported in the vertical direction, instead of the conventional manner in which a steel sheet is conveyed in a furnace while being horizontally supported by rollers.

Solution to Problem

In order to achieve the above object, the present invention provides a steel sheet heating method that heats a steel sheet to be pressed before hot press molding, the steel sheet heating method including: bringing the steel sheet into a heating furnace including a heater on an inside surface of the heating furnace in a state where the steel sheet is supported in a vertical direction while an unnecessary portion of the steel sheet that becomes unnecessary after molding is fixedly supported by a support member; and performing heating at a prescribed temperature in the heating furnace, then taking the steel sheet out of the heating furnace, and after that removing the unnecessary portion.

The "after that" herein is not limited to the time immediately after being taken out of the heating furnace, and may be the time of performing hot press molding after the taking-out.

Examples of the "fixed support" in the present invention include holding the unnecessary portion mentioned above with a clamp and hanging the unnecessary portion by locking it with the support member. It is preferable that the steel sheet be fixedly supported at two or more places. This is because the steel sheet can thereby be prevented from bending when the steel sheet has a long-length shape, for example. When the steel sheet has a long length, for example when the length in the longitudinal direction of the steel sheet is more than 1 m, the steel sheet is preferably fixedly supported at both ends thereof.

According to the present invention, since a steel sheet is heated in the heating furnace in a state of being fixedly supported in the vertical direction by the support member, there is no harmful effect like conventional ones occurring in relation to the use of rollers, and the radiation efficiency is good and also the energy efficiency is good. Furthermore, by the fixed support in the vertical direction by means of the support member, the bending of the steel sheet can be suppressed. Here, the unnecessary portion that becomes unnecessary after molding refers to a portion that becomes unnecessary as a product after the steel sheet is molded. The "fixedly supporting the unnecessary portion by means of the support member" refers to fixedly supporting the whole or part of the unnecessary portion by means of the support member.

In the method, the steel sheet may be moved in a vertical direction in the heating furnace.

Furthermore, tension may be applied to the steel sheet fixedly supported.

According to another aspect, the present invention provides a steel sheet heating apparatus that heats a steel sheet to be pressed before hot press molding, the steel sheet heating apparatus including: a heating furnace capable of accommodating the steel sheet in a vertical state; and a conveyance apparatus that allows the steel sheet to pass through a conveyance path of the heating furnace in a state of being supported in a vertical direction by a support member. The heating furnace includes the conveyance path of the steel sheet formed between side walls facing each other and a heater that is provided on at least one surface of the side walls and heats the steel sheet. The conveyance apparatus includes the support member that fixedly supports an unnecessary portion of the steel sheet that becomes unnecessary after molding and a moving mechanism that moves the support member along a rail provided from above an upstream side of an entrance to above a downstream side of an exit of the heating furnace.

In this case, a vertical drive mechanism that moves the support member in a vertical direction may be further included.

In addition, a shearing mechanism that shears the unnecessary portion on the downstream side of the exit of the heating furnace may be further included.

Furthermore, a mechanism that applies tension to the steel sheet fixedly supported may be further included.

Advantageous Effects of Invention

According to the present invention, there is no harmful effect like conventional ones occurring in relation to the use of rollers when a steel sheet to be pressed is heated before hot press molding, and the radiation efficiency is good and also the energy efficiency is good. Furthermore, a steel sheet to be pressed can be heated more uniformly than in the past.

DESCRIPTION OF EMBODIMENTS

Figure 1:
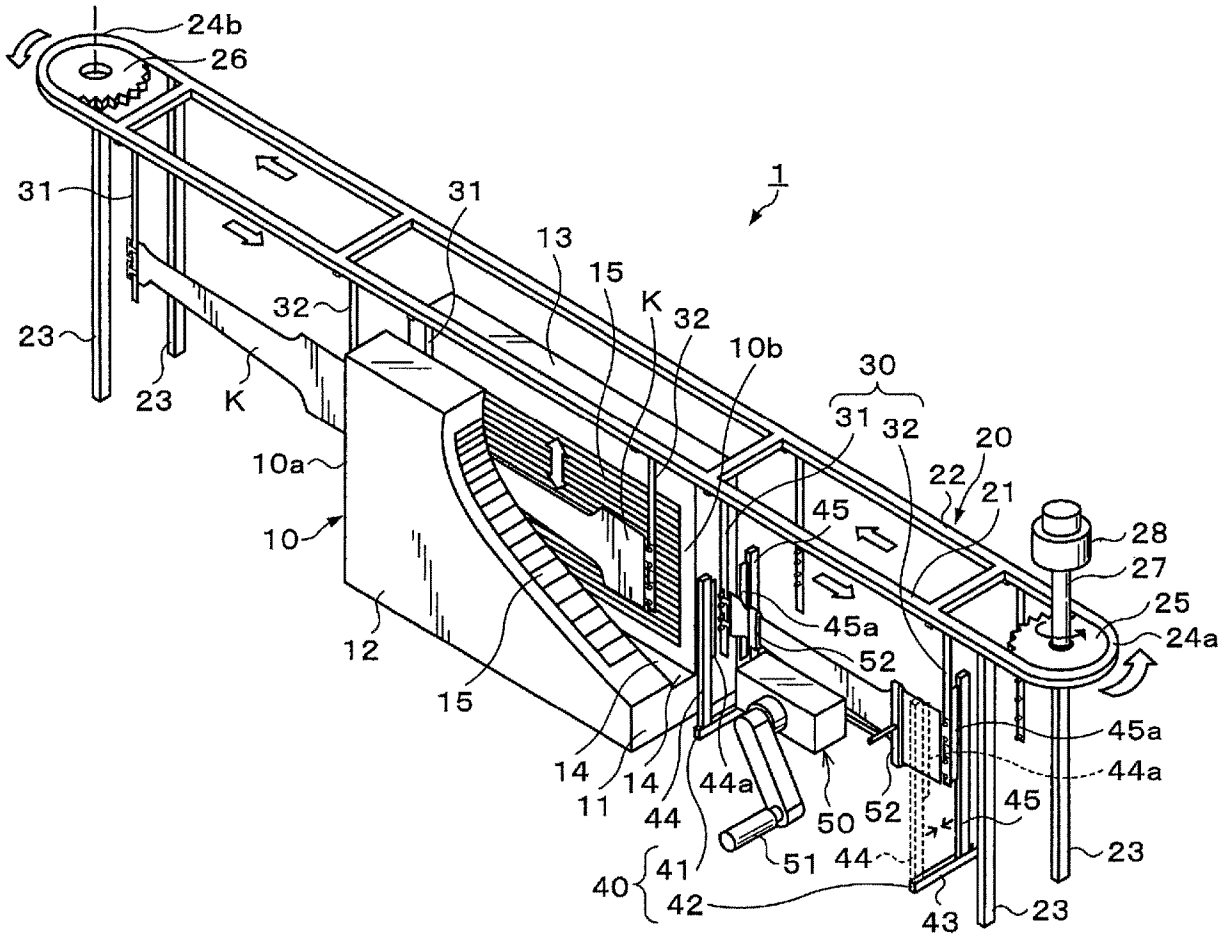
FIG. 1 is a perspective view of a steel sheet heating apparatus according to an embodiment.

Hereinbelow, embodiments of the present invention are described. FIG. 1 shows an overview of a steel sheet heating apparatus 1 according to an embodiment; a heating furnace 10 in the steel sheet heating apparatus 1 of the embodiment includes side wall bodies 12 and 13 in a facing manner individually on both sides of a base 11, and the long, narrow space between the side wall bodies 12 and 13 forms a conveyance path 14 of a steel sheet K. Heaters 15 and 15 are provided on the inside of the side wall bodies 12 and 13, respectively (FIG. 1 is depicted with part of the heating furnace 10 broken off for convenience of illustration).

As the heater 15, for example, an electric heater, a far-infrared heater, a near-infrared lamp, an induction heating means, or the like may be used. Although in the embodiment the heater 15 is provided individually on both surfaces of the side wall bodies 12 and 13, the heater 15 may be provided only on one side wall surface depending on the type, size, shape, etc. of the steel sheet.

A conveyance apparatus 20 of the steel sheet heating apparatus 1 according to the embodiment includes a forward rail housing 21 provided from above the entrance 10*a* side of the heating furnace 10 (the back side of the drawing) to above the exit 10*b* side of the heating furnace 10 (the front side of the drawing) and a backward rail housing 22 provided parallel to the forward rail housing 21. Each of the forward rail housing 21 and the backward rail housing 22 is supported by support columns 23. A support member moving path 24*a* and a support member moving path 24*b* in a curved line form in a planar view, which serve also as a horizontal rail, are stretched between the ends of the forward rail housing 21 and the backward rail housing 22.

The forward rail housing 21 and the backward rail housing 22 basically have the same configuration; a detailed description thereof is given as follows based on the forward rail housing 21 shown in FIG. 2 and FIG. 3: the forward rail housing 21 houses a chain conveyor 21*b* serving as a drive mechanism on the upper side of the interior of a main body unit 21*a* in which the lower surface side is opened and the cross section is shaped like a trench, and houses a rail body 21*c* on the lower side. As shown in FIG. 1, the chain conveyor 21*b* is stretched between a gear sprocket 25 provided on the support member moving path 24*a* side and a gear sprocket 26 provided on the support member moving path 24*b* side, and moves cyclically between the forward rail housing 21, the support member moving path 24*a*, the backward rail housing 22, and the support member moving path 24*b* by the operation of a drive source 28 such as a motor connected to the gear sprocket 25 via a shaft 27.

A support member 30 in the embodiment is supported directly by the rail body 21*c*. As shown in FIG. 3, the support member 30 includes two hanging members 31 and 32. The hanging members 31 and 32 have the same configuration, and thus the hanging member 31 is taken representatively for description; as shown in FIG. 2, the hanging member 31 is provided with a rail running member 33 and a cylinder 34, at a bracket 31*a*.

The rail running member 33 includes an engaging unit 33*a* engaging with the chain conveyor 21*b* and a running unit 33*c* provided with rollers 33*b* capable of running the rail body 21*c* mentioned above. The cylinder 34 is fixed to the bracket 31 a, and a rod member 34*a* that extends and contracts by the operation of the cylinder 34 is suspended below the bracket 31*a* and has a support body 34*b* at its lower end. Therefore, the support body 34*b* moves vertically by the operation of the cylinder 34.

Figure 4:
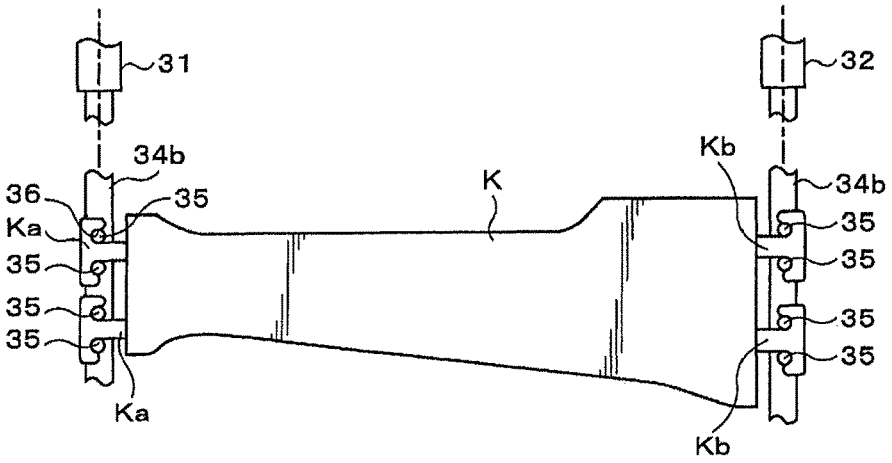
FIG. 4 is a front view of a steel sheet supported by a support body of the support member.

As shown in FIG. 4, a plurality of protrusions 35 are provided on a lower portion of the support body 34*b* in the vertical direction (in the example of the drawing, on four places). The steel sheet K is locked with the protrusions 35 and is supported between the support bodies 34*b* and 34*b* of the hanging members 31 and 32. That is, extension members Ka and Kb that have no relation to the original product, i.e. are unnecessary portions that become unnecessary after molding, have been formed at both ends of the steel sheet K in advance, and a locking portion 36 to be locked with the protrusion 35 of the support body 34*b* is formed in the extension members Ka and Kb; and by the locking portion 36 being locked with the protrusion 35, the steel sheet K is locked with the protrusions 35 and is supported between the support bodies 34*b* and 34*b* of the hanging members 31 and 32.

Figure 5:
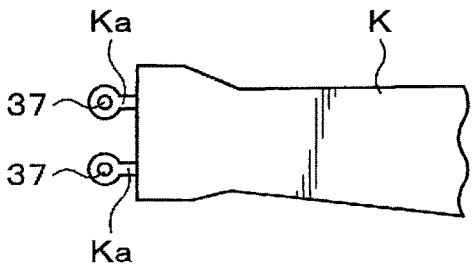
FIG. 5 is a front view of a main portion of a steel sheet showing another example of an extension member.

In the example of the embodiment, the extension members Ka and Kb are in a T-shaped configuration, and the inside thereof is notched to form the locking portions 36; but instead, as shown in FIG. 5, the steel sheet K may be supported between the support bodies 34*b* and 34*b* of the hanging members 31 and 32 in such a manner that a hole 37 is formed in the extension member Ka extending from an end of the steel sheet K in the horizontal direction and the protrusion 35 of the support body 34*b* is inserted into the hole 37.

Instead of thus supporting the steel sheet K by hanging the steel sheet K between the support bodies 34*b* and 34*b* of the hanging members 31 and 32 using the extension members Ka and Kb, for example, a clamping mechanism (not shown) that clamps the extension members Ka and Kb may be provided in the hanging members 31 and 32, and thus the extension members Ka and Kb may be clamped to fixedly support the steel sheet K in the vertical direction.

Figure 3:
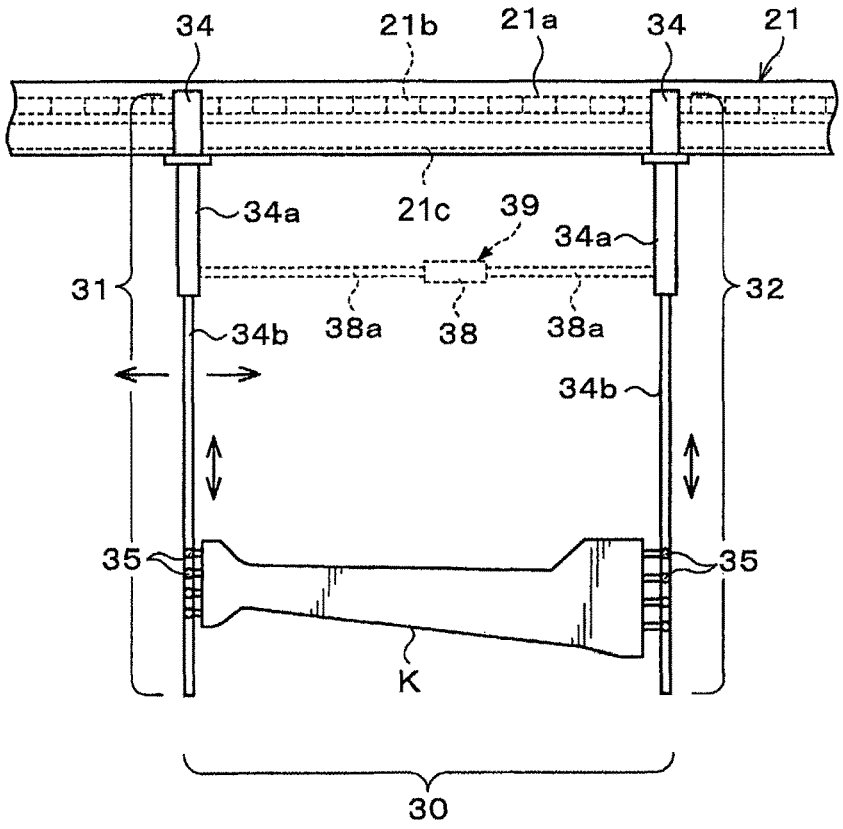
FIG. 3 is a front view of a support member.

As shown by the broken line of FIG. 3, a tension application mechanism 39 that includes a cylinder 38 and rods 38*a* and 38*a* protruding on both sides may be provided between, for example, the rod members 34*a* and 34*a* of the two hanging members 31 and 32. By putting the cylinder 38 of the tension application mechanism 39 into operation, the rods 38*a* extend and contract to allow the spacing between the hanging members 31 and 32 to become wider; thereby, tension can be applied to the steel sheet K supported between the support bodies 34*b* and 34*b* of the hanging members 31 and 32.

Referring to FIG. 1 again for description, the steel sheet heating apparatus 1 includes, as mentioned above, the forward rail housing 21 and the backward rail housing 22 provided parallel to the forward rail housing 21, and the backward rail housing 22 has the same configuration as the forward rail housing 21.

In the embodiment, as described above, the support member moving path 24*a* and the support member moving path 24*b* are stretched between the ends of the forward rail housing 21 and the backward rail housing 22, and the hanging members 31 and 32 of the support member 30 that has been located on the backward rail housing 22 side can be moved to the forward rail housing 21 side, that is, to the entrance 10*a* side of the heating furnace 10, via the support member moving path 24*b*.

Furthermore, the hanging members 31 and 32 of the support member 30 that has been located on the forward rail housing 21 side, i.e. on the exit 10*b* side of the heating furnace 10, can be moved to the backward rail housing 22 side via the support member moving path 24*a*. For the hanging members 31 and 32 to be inserted into the furnace, heat-resistant steel or the like with high heat resistance and thermal shock properties is used; and the hanging members 31 and 32 may be protected with a heat insulating material, which should usually be considered as a means for protecting the furnace equipment, and may be provided with a flow path inside and use a cooling means based on a cooling medium such as cooling water or air.

In the embodiment, a shearing mechanism 40 that shears the extension members Ka and Kb of the steel sheet K that has undergone the heating by the heating furnace 10 and is located on the exit 10*b* side of the heating furnace 10 while being supported by the hanging members 31 and 32 of the support member 30 is provided on the exit 10*b* side of the heating furnace 10.

The shearing mechanism 40 includes a pair of shearing apparatuses 41 and 42. The shearing apparatuses 41 and 42 have the same structure; for example, a detailed description of the shearing apparatus 42 is given as follows: the shearing apparatus 42 includes a base 43 and shearing members 44 and 45 provided perpendicular to the base 43 and facing each other. The shearing members 44 and 45 move along the base 43 by means of a drive mechanism (not shown), and can come close to and go away from each other freely. Blades 44*a* and 45*a* are provided on the facing surface sides of the shearing members 44 and 45, respectively. Therefore, by the shearing members 44 and 45 coming close together, by means of the blades 44*a* and 45*a* thereof, the extension members Ka and Kb of the steel sheet K supported between the hanging members 31 and 32 can be sheared.

A conveyance robot 50 including an articulated arm that holds the steel sheet K supported by the hanging members 31 and 32 of the support member 30 may be placed on the exit 10*b* side of the heating furnace 10. The conveyance robot 50 has the function of setting two clamp-type chucks 52 and 52 to ON or OFF by the rotational movement operation of a handle 51. The conveyance robot 50 includes a moving mechanism (not shown) that can move from the position on the exit 10*b* side of the heating furnace 10 freely, and can convey the held steel sheet to a hot press molding apparatus described later.

The steel sheet heating apparatus 1 according to the embodiment is configured in the above manner; next, a steel sheet heating method using the steel sheet heating apparatus 1 is described.

First, the steel sheet K to be molded by hot press molding is supported at the hanging members 31 and 32 of the support member 30 located on the forward rail housing 21 side, on the entrance 10*a* side of the heating furnace 10. Then, tension is applied to the supported steel sheet in the horizontal direction by the tension application mechanism 39 shown in FIG. 3.

In this state, the drive mechanism of the forward rail housing 21 is put into operation to drive the chain conveyor 21*b*, and thereby the hanging members 31 and 32 of the support member 30 supporting the steel sheet K are moved to the heating furnace 10; and the steel sheet K is heated to a prescribed temperature, for example 700° C. to 1000° C., by the heaters 15 in the heating furnace 10. At this time, the cylinders 34 of the hanging members 31 and 32 may be put into operation to extend and contract the rod members 34*a*, and thus the steel sheet K supported at the hanging members 31 and 32 can be moved in the vertical direction.

After the steel sheet K is heated to the prescribed temperature, the chain conveyor 21 b of the forward rail housing 21 is driven, and thus the hanging members 31 and 32 of the support member 30 supporting the steel sheet K are taken out of the heating furnace 10 and are moved to the space on the exit 10*b* side of the heating furnace 10. The steel sheet K may be heated in the heating furnace 10 while being conveyed constantly, or may be heated in a state of being stationary in the heating furnace 10.

After the hanging members 31 and 32 of the support member 30 supporting the steel sheet K have stopped in a prescribed position in the space on the exit 10*b* side of the heating furnace 10, the conveyance robot 50 is brought close to the steel sheet K, and the steel sheet K is held by the chucks 52 and 52. After that, the tension applied to the steel sheet K the tension application mechanism 39 is released; and the shearing apparatuses 41 and 42 are put into operation, and the extension members Ka and Kb of the steel sheet K supported between the hanging members 31 and 32 are sheared by the shearing members 44 and 45. Thus, the conveyance robot 50 enters a state of supporting the steel sheet K from which the extension members Ka and Kb, which are unnecessary portions after molding, have been removed.

Figure 6:
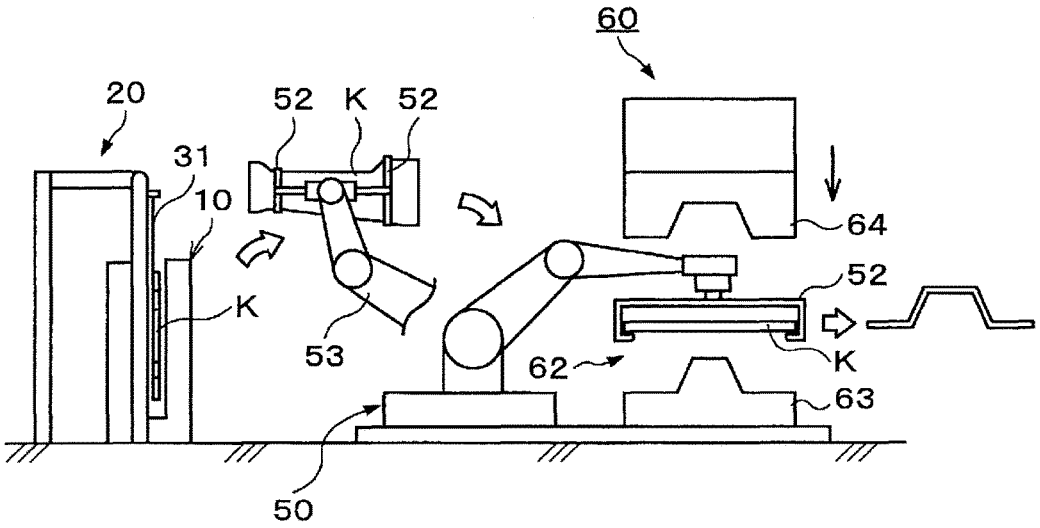
FIG. 6 is an illustration diagram schematically describing the steel sheet heating apparatus and a hot press molding apparatus.

After that, as shown in FIG. 6, while the steel sheet K is held by the chucks 52 and 52, the steel sheet K is conveyed by an articulated arm 53 of the conveyance robot 50 to a lower mold 63 of a molding and rapid cooling stage 62 of a hot press molding apparatus 60, which stage performs press molding and rapid cooling treatment. Then, after the steel sheet K is set in a prescribed position, prescribed press molding by the pressing of an upper mold 64 and rapid cooling treatment are performed on the steel sheet K, and the steel sheet K is processed into a prescribed product.

Thus, by the embodiment of the present invention, the steel sheet K is brought into and heated by the heating furnace 10 including the heaters 15 on the surfaces of the side wall bodies 12 and 13 in a state where the steel sheet K is fixedly supported in the vertical direction via the extension members Ka and Kb, which are unnecessary portions that become unnecessary after press molding, by the hanging members 31 and 32 of the support member 30; therefore, as compared with a conventional system in which a steel sheet is heated while being supported in a horizontal state by rollers, firstly, the steel sheet K can be heated more uniformly than in the past without the steel sheet K meandering. Furthermore, since there is no shield between the heater 15 and the steel sheet K, the heat from the heater 15 can be given to the steel sheet K with good efficiency, and the radiation efficiency is good and more rapid heating than in the past is possible. In addition, since at times other than heating there is no need to put the support member 30 in movement, the energy efficiency is better than in the past. In addition, since rollers are not used, there is no possibility of shutdown due to damage to rollers.

Furthermore, in the embodiment described above, since the support body 34*b* supporting the steel sheet K can be moved vertically by putting the cylinder 34 of the support member 30 into operation, the heating unevenness can be suppressed by putting the cylinder 34 into operation to move the steel sheet K in the vertical direction while the steel sheet K is located in the heating furnace 10, and thereby more uniform heating can be made. Therefore, also heating unevenness in the vertical direction due to the arrangement of heaters 15 and the variation in heating output characteristics can be prevented.

Furthermore, in the embodiment described above, since the steel sheet K to be heated is fixedly supported in the vertical direction via the extension members Ka and Kb by the hanging members 31 and 32 of the support member 30 and, in particular, is fixedly supported at two places of both ends, the steel sheet K does not bend even when the steel sheet K has a shape long in the horizontal direction. Furthermore, since tension is applied to the steel sheet K to be heated in the horizontal direction by the tension application mechanism 39, the deformation due to the reduction in rigidity and the thermal expansion of the steel sheet K during heating can be suppressed.

Furthermore, since the extension members Ka and Kb of the steel sheet K used when the steel sheet K is fixedly supported in the vertical direction are unnecessary portions that become unnecessary after press molding, the steel sheet K itself can be heated uniformly in whole. Moreover, in the case where the steel sheet K is a plated steel sheet, even when it is heated in the melting temperature range, there is no concern that the molten plating material will adhere to the steel sheet K again.

In the embodiment described above, since the extension members Ka and Kb are, immediately after heating, sheared and removed in the steel sheet heating apparatus 1 by the shearing mechanism 40 installed in the steel sheet heating apparatus 1, the extension members Ka and Kb, which are unnecessary portions, can be removed in a state of high temperature and low strength, and there is no influence on the shape, quality, and performance of the product after molding. The extension members Ka and Kb left on the hanging members 31 and 32 of the support member 30 after shearing may be collected to a collection box or the like via a chute (not shown) or the like. In the case where the press mold can be provided with a shearing mechanism, the extension members Ka and Kb may be sheared and removed simultaneously with the pressing in the hot press molding apparatus 60.

The hanging members 31 and 32 of the support member 30 after the steel sheet K is conveyed by the conveyance robot 50 in the above way may be moved to the backward rail housing 22 side through the support member moving path 24*a* and then moved to the entrance 10*a* side of the heating furnace 10 through the support member moving path 24*b*, and the steel sheet K to be processed next may be set at the hanging members 31 and 32 of the support member 30 again in a prescribed position on the entrance 10*a* side of the heating furnace 10.

As is clear from FIG. 1, the steel sheet heating apparatus 1 uses the heating furnace 10 that heats the steel sheet K in a vertical state from both sides, and the forward rail housing 21 and the backward rail housing 22 of the conveyance apparatus 20 are installed above the heating furnace 10; therefore, the occupied floor area is much smaller than that of a conventional horizontal support-type heating furnace, and thus a large number of steel sheet heating apparatuses 1 can be juxtaposed. Therefore, productivity is very good in operation with the same floor area.

Figure 2:
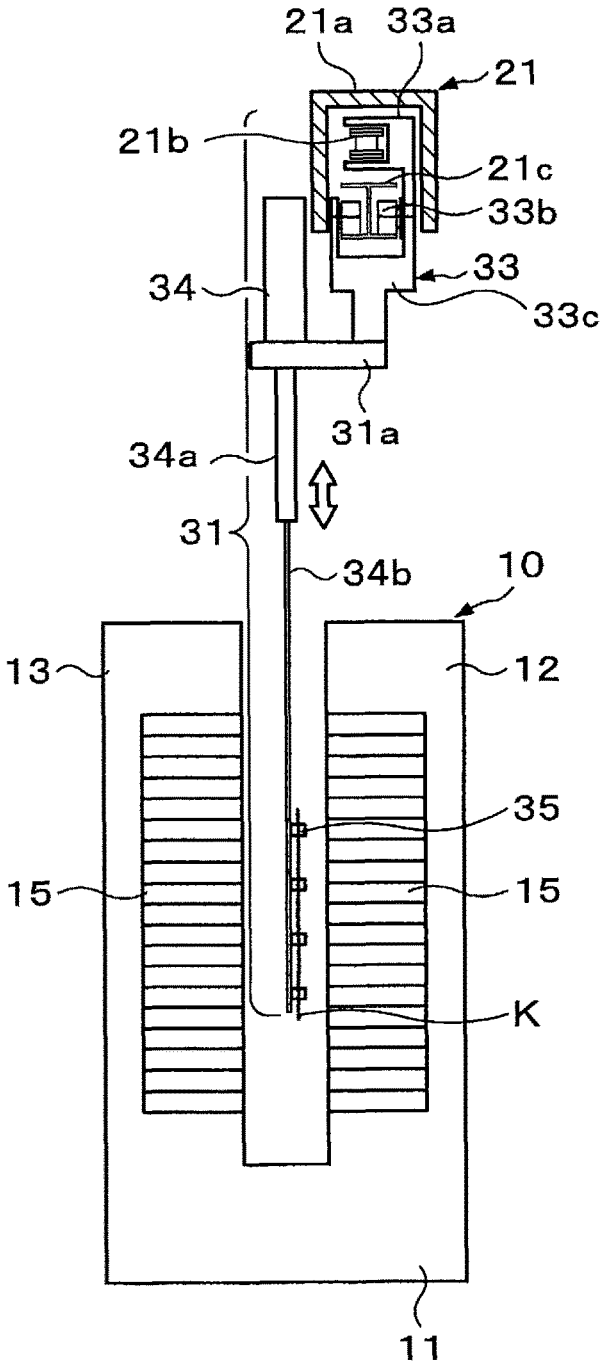
FIG. 2 is an illustration diagram of a heating furnace in the steel sheet heating apparatus of FIG. 1 as viewed from the entrance side in the conveyance direction.

Furthermore, in the embodiment described above, the movement of the hanging members 31 and 32 of the support member 30 is based on the chain conveyor 21*b* installed in the forward rail housing 21 and the backward rail housing 22, and an arrangement in which the drive mechanism is installed outside the heating furnace 10 and the forward rail housing 21 does not receive radiant heat directly from the opening of the heating furnace as shown in FIG. 2 is possible; thus, the thermal effect from the heating furnace 10 on the drive system can be suppressed to a minimum. When a thermal shield is provided as appropriate, the support member 30 itself may be equipped with a self-propelled drive mechanism, as a matter of course.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

INDUSTRIAL APPLICABILITY

The present invention is useful for the heating of a steel sheet before the steel sheet is molded by hot press molding.

REFERENCE SIGNS LIST

1 steel sheet heating apparatus
10 heating furnace
10*a* entrance
10*b* exit
11 base
12, 13 side wall body
14 conveyance path
15 heater
20 conveyance apparatus
21 forward rail housing
21*a* main body unit
21*b* chain conveyor
21*c* rail body
22 backward rail housing
23 support column
24*a*, 24*b* support member moving path
25, 26 gear sprocket
27 shaft

28 drive source
30 support member
31, 32 hanging member
31*a* bracket
33 rail running member
33*a* engaging unit
33*b* roller
33*c* running unit
34 cylinder
34*a* rod member
34*b* support body
35 protrusion
36 locking portion
37 hole
38 cylinder
38*a* rod
39 tension application mechanism
40 shearing mechanism
41, 42 shearing apparatus
43 base
44, 45 shearing member
44*a*, 45*a* blade
50 conveyance robot
51 handle
52 chuck
53 articulated arm
60 hot press molding apparatus
62 molding and rapid cooling stage
63 lower mold
64 upper mold
K steel sheet
Ka, Kb extension member

The invention claimed is:

1. A steel sheet heating method that heats a steel sheet to be pressed before hot press molding, the steel sheet heating method comprising:

bringing the steel sheet into a heating furnace including a heater on an inside surface of the heating furnace in a state where the steel sheet is supported in a vertical direction while an unnecessary portion of the steel sheet that becomes unnecessary after molding is fixedly supported only at both ends of the steel sheet in a horizontal direction by a support member; and performing heating at a prescribed temperature in the heating furnace while applying tension in the horizontal direction to the steel sheet through the unnecessary portion by a plurality of rods configured to contract and extend between the both ends of the steel sheet, then taking the steel sheet out of the heating furnace, and removing the unnecessary portion after taking the steel sheet out of the heating furnace.

2. The steel sheet heating method according to claim 1, wherein the steel sheet is moved in a vertical direction in the heating furnace.

3. A steel sheet heating apparatus that heats a steel sheet to be pressed before hot press molding, the steel sheet heating apparatus comprising:

a heating furnace capable of accommodating the steel sheet in a vertical state; and a conveyance apparatus that allows the steel sheet to pass through a conveyance path of the heating furnace in a state of being supported in a vertical direction only at both ends of the steel sheet in a horizontal direction by a support member, wherein the heating furnace includes the conveyance path of the steel sheet formed between side walls facing each other and a heater that is provided on at least one surface of the side walls and heats the steel sheet, and wherein the conveyance apparatus includes the support member that supports the steel sheet while fixedly supporting an unnecessary portion of the steel sheet that becomes unnecessary after molding, a tension application mechanism including a plurality of rods configured to contract and extend between the both ends of the steel sheet to apply tension in the horizontal direction to the steel sheet through the unnecessary portion, and a moving mechanism including a motor that moves the support member along a rail provided from above an upstream side of an entrance to above a downstream side of an exit of the heating furnace.

4. The steel sheet heating apparatus according to claim 3, further comprising a vertical drive mechanism including a cylinder that moves the support member in a vertical direction.

5. The steel sheet heating apparatus according to claim 4, further comprising a shearing mechanism including blades that shears the unnecessary portion on the downstream side of the exit of the heating furnace.

6. The steel sheet heating apparatus according to claim 3, further comprising a shearing mechanism including blades that shears the unnecessary portion on the downstream side of the exit of the heating furnace.

* * * * *